US009757785B2

(12) United States Patent
Park et al.

(10) Patent No.: US 9,757,785 B2
(45) Date of Patent: Sep. 12, 2017

(54) MULTI-FORMING DEVICE

(71) Applicant: SUNGWOO HITECH CO., LTD., Busan (KR)

(72) Inventors: Sanghyun Park, Busan (KR); Rae Hyeong Kim, Busan (KR); Mun Yong Lee, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 0 days.

(21) Appl. No.: 15/156,460

(22) Filed: May 17, 2016

(65) Prior Publication Data

US 2017/0182541 A1 Jun. 29, 2017

(30) Foreign Application Priority Data

Dec. 29, 2015 (KR) ..... 10-2015-0188970

(51) Int. Cl.
*B21D 26/02* (2011.01)
*B21D 26/027* (2011.01)
(Continued)

(52) U.S. Cl.
CPC ..... *B21D 26/027* (2013.01); *B21D 26/031* (2013.01); *B21D 26/055* (2013.01)

(58) Field of Classification Search
CPC .... B21D 26/02; B21D 26/021; B21D 26/027; B21D 26/031; B21D 26/055; B21D 22/022
See application file for complete search history.

(56) References Cited

U.S. PATENT DOCUMENTS

2005/0067063 A1* 3/2005 Schroth ..... B21D 26/021 148/511
2007/0044529 A1* 3/2007 Kruger ..... B21D 22/02 72/60
2009/0145192 A1* 6/2009 Friedman ..... B21D 26/055 72/60

FOREIGN PATENT DOCUMENTS

JP 2005-297048 10/2005

* cited by examiner

*Primary Examiner* — Debra Sullivan
(74) *Attorney, Agent, or Firm* — Lex IP Meister, PLLC

(57) ABSTRACT

A multi-forming device is disclosed. A multi-forming device according to an exemplary embodiment of the present invention may include: a lower mold die; a lower mold that is disposed at a center upper surface of the lower mold die, in which a gas passage is formed in an up-and-down direction to receive a shaping gas from an outside gas supplier device, in which a lower mold surface is formed at an upper surface thereof, and in which a plurality of heating cartridges are disposed therein along the lower surface thereof; an upper mold that is disposed on an upper side slider to be moved in an up-and-down direction corresponding to the lower mold, in which an upper mold surface is formed at a lower surface corresponding to the lower mold, in which an upper mold face is formed at a circumference of the upper mold surface, and in which a plurality of heating cartridges are disposed along the upper mold surface; a blank holder through which the lower mold is inserted and that is disposed to move in an up-and-down direction through a cushion spring on the lower mold die, and in which a holder face is formed to grasp a material together with the upper mold face at an early stage of a forming process; an inner gas pipe that is disposed in a gas passage of the lower mold; and a switch valve that switches supply
(Continued)

passages of the shaping gas that is supplied to the inner gas pipe and the gas passage.

17 Claims, 7 Drawing Sheets

(51) Int. Cl.
*B21D 26/031* (2011.01)
*B21D 26/055* (2011.01)

MULTI-FORMING DEVICE

CROSS-REFERENCE TO RELATED APPLICATION

This application claims priority to and the benefit of Korean Patent Application No. 10-2015-0188970 filed in the Korean Intellectual Property Office on Dec. 29, 2015, the entire contents of which are incorporated herein by reference.

BACKGROUND OF THE INVENTION (a) Field of the Invention

The present invention relates to a multi-forming device. More particularly, the present invention relates to a multi-forming device that uses one mold to perform warm forming and blow forming and produces a product having a deep deformation depth and a complicated shape through one process.

(b) Description of the Related Art

Generally, a warm forming process has been developed to press a magnesium alloy sheet of a lightweight material of which a density of the metal structure is lower than that of an aluminum alloy sheet, and has recently been under development and is being applied by demand of various press forming methods so as to apply a magnesium alloy sheet to a vehicle body for the purpose of producing a lightweight and high strength vehicle body in America.

That is, a warm forming method is performed at an intermediate temperature range between cold forming and hot forming temperatures, wherein a sheet receives heat energy from a high temperature mold that is heated by a heat source, and press forming is performed under conditions that a yield strength is reduced and an elongation rate is improved.

The magnesium alloy sheet to which the warm forming method is applied has an HCP (hexagonal closed packed) crystal lattice structure, so it is difficult to apply a press forming method thereto at room temperature due to the crystal structure, and formability is quickly improved by a characteristic that a non-basal plane slip system is activated in a high temperature region (of higher than 200° C.).

However, the magnesium has high specific strength, and it can be light in weight at 30% lighter than an aluminum alloy, but it is disadvantageous in an aspect of cost, corrosion, formability, and welding characteristics compared to other materials such as an aluminum alloy.

Particularly, in a case that a product having a complicated shape or a product having a large deformation depth is produced, there are drawbacks that the number of processes and the number of components are increased due to limitations of formability, forming cost is increased, and productivity is deteriorated.

Meanwhile, an aluminum alloy is disadvantageous in terms of weight compared to a magnesium alloy and is advantageous in an aspect of material cost and formability, and thus a die casting process has been used therewith to produce a product of which a forming shape is complicated and a deformation depth is large.

However, the die casting method injects a molten metal of an aluminum alloy into a die to perform casting, wherein the facility cost is high for mass production, the number of the processes is larger, and there is a drawback in terms of productivity.

Therefore, a new forming method that uses super-plasticity as a physical characteristic of an aluminum alloy has recently attracted attention, wherein the super-plasticity is a characteristic that the material shows extreme ductility without local shrinkage when the material is deformed under a specific temperature condition.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a multi-forming device having advantages that a separate inner gas pipe is disposed in a gas passage of a lower mold, a switch valve is disposed on the gas pipe to be operated, after an initial forming pressure is formed to deform a material a swirl is generated within a shaping gas that is supplied through a gas passage, and a shaping gas of a high temperature does not leak and uniformly flows therein to improve blow formability, when an aluminum alloy is deformed by blow forming to a final shape of a product at a super-plasticity temperature of the aluminum alloy after the aluminum alloy is deformed to maximum deformation depth through plastic deformation in a warm condition.

A multi-forming device according to an exemplary embodiment of the present invention may include: a lower mold die; a lower mold that is disposed at a center upper surface of the lower mold die, in which a gas passage is formed in an up-and-down direction to receive a shaping gas from an outside gas supplier device, in which a lower mold surface is formed at an upper surface thereof, and in which a plurality of heating cartridges are disposed therein along the lower mold surface thereof; an upper mold that is disposed on an upper side slider to be moved in an up-and-down direction corresponding to the lower mold, in which an upper mold surface is formed at a lower surface corresponding to the lower mold, in which an upper mold face is formed at a circumference of the upper mold surface, and in which a plurality of heating cartridges are disposed along the upper mold surface thereof; a blank holder through which the lower mold is inserted and that is disposed to move in an up-and-down direction through a cushion spring on the lower mold die, and in which a holder face is formed to grasp a material together with the upper mold face at an early stage of a forming process; an inner gas pipe that is disposed in a gas passage of the lower mold; and a switch valve that switches supply passages of the shaping gas that is supplied to the inner gas pipe and the gas passage.

The material may include a super-plasticity material.

The super-plasticity material may be an aluminum alloy plate.

The inner gas pipe may be disposed to penetrate a central portion of an inside of the gas passage, and an expanded tube portion that is expanded to a trumpet shape is formed at an upper end portion that is close to a lower mold surface.

A spiral swirl rib may be formed on an exterior circumference of the expanded tube portion to swirl shaping gas that is supplied from the gas passage.

An expanded hole portion of which an interior diameter becomes larger may be formed on the gas passage corresponding to the expanded tube portion.

The gas supply pipe may be connected with the gas passage through a space portion that is formed at a center portion of the lower mold die.

The switch valve may include: a valve housing that has a first port receiving hydraulic pressure from the gas supply pipe, a second port that supplies hydraulic pressure of the first port to the inner gas pipe, and a third port that supplies hydraulic pressure of the first port to the gas passage; a valve spool that has a first land supported by a return spring of the valve housing, a second land that forms a passage connecting the first port with the second port together with the first land, and a third land simultaneously connecting the first port, the second port, and the third port with each other together with the second land; and a solenoid that is connected with one end of the valve spool to operate the valve spool depending on a control signal.

The lower mold surface may have an incomplete product shape so as to deform the material to a maximum deformation depth.

The upper mold surface may have a final product shape surface to deform the material to a final product shape.

An exemplary embodiment of the present invention uses one mold set to perform warm forming where an upper mold and a lower mold are united to form an aluminum alloy plate having super-plasticity to a maximum deformation depth through plastic deformation in a warm condition, and also uses blow forming with a high temperature gas to deform a product to a final shape at a super-plasticity temperature of the aluminum alloy plate.

Particularly, while a product is deformed to a final shape through blow forming at a super-plasticity temperature of an aluminum alloy, a swirl is formed within a shaping gas that has passed a gap of a deformed material through a gas passage, and thus a high temperature shaping gas does not leak and uniformly flows therein to improve blow formability, in a condition that an inner gas pipe is disposed in a gas passage of a lower mold to be opened/closed by a switch valve and an initial pressure is generated to deform an aluminum alloy plate P.

Also, when a product having a deep deformation depth and a complicated shape is formed, the number of components is minimized and there is an advantage in terms of cost through a minimized process.

In addition, a part having a complicated shape is formed by blow forming, wherein a high pressure gas deforms the part without contact with a mold, and thus a defect rate is minimized compared to a conventional die-casting method.

DETAILED DESCRIPTION OF THE EMBODIMENTS

Figure 1:
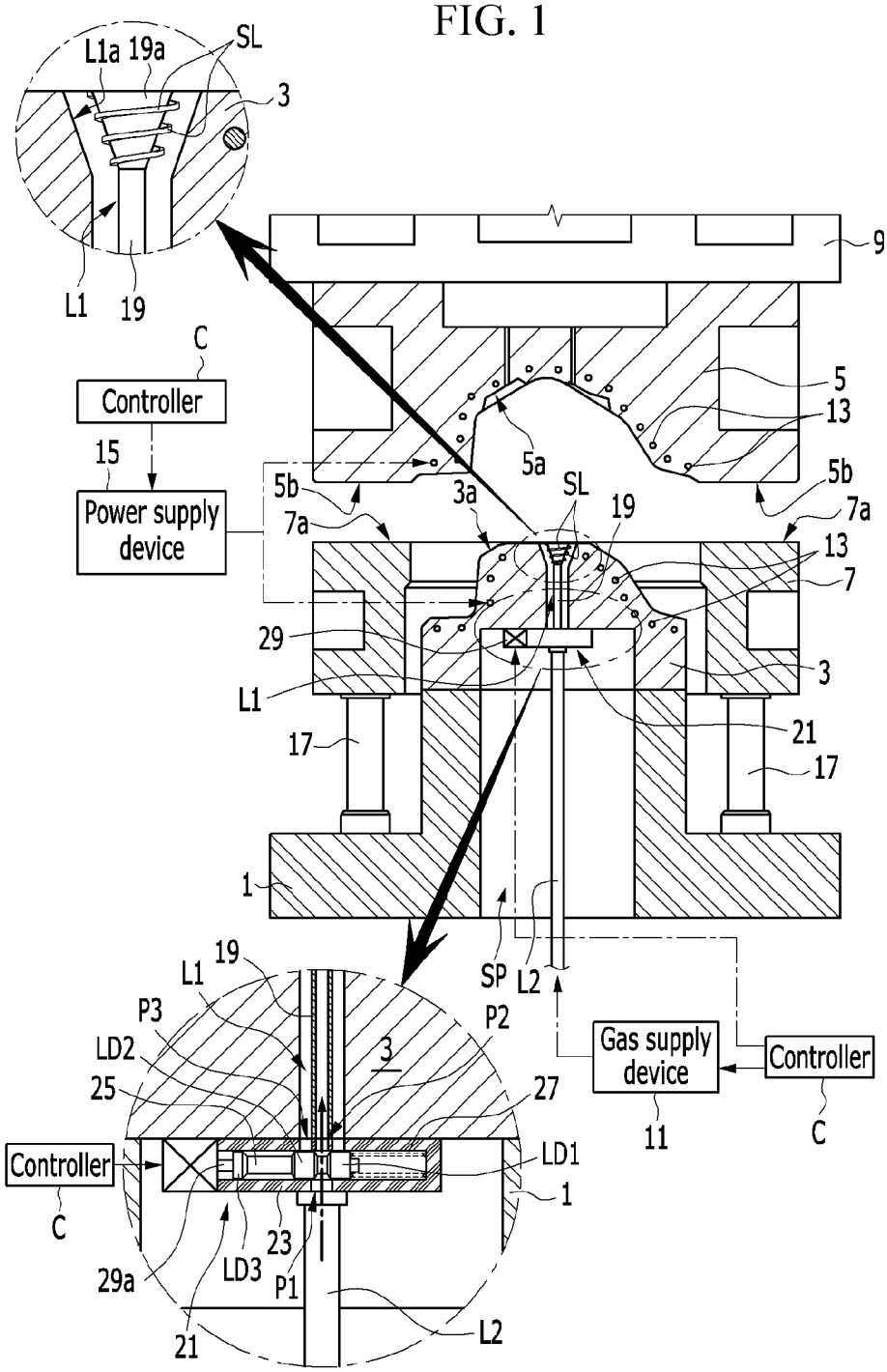
FIG. 1 is a sectional schematic diagram of a multi-forming device according to an exemplary embodiment of the present invention.

Hereinafter, an exemplary embodiment of the present invention will be described with reference to accompanying drawings.

Further, the sizes and thicknesses of the configurations shown in the drawings are selectively provided for convenience of description, and the present invention is not limited to those shown in the drawings, and to clearly describe the present invention, parts that are irrelevant to the description will be omitted.

FIG. 1 is a sectional schematic diagram of a multi-forming device according to an exemplary embodiment of the present invention.

Referring to FIG. 1, in a multi-forming device according to an exemplary embodiment of the present invention, after an aluminum alloy plate as a super-plasticity material is shaped by warm-forming to a maximum deformation depth, while it is being shaped to a final product by blow-forming, an initial shaping pressure of a material is formed by a switch valve that is disposed on an inner gas pipe that is disposed in a gas passage of a lower mold, a swirl is generated in a shaping gas that is supplied through a gas passage, and a high temperature shaping gas does not leak and uniformly flows therein to improve blow formability.

Here, the super-plasticity material shows extreme ductility without local shrinkage when the material is deformed under a specific temperature condition, and the material can be an aluminum alloy sheet in an exemplary embodiment of the present invention.

That is, a multi-forming device according to an exemplary embodiment of the present invention performs warm forming that forms a material to a maximum forming depth through pressurized plastic deformation below an annealing temperature that lowers dislocation density within a material having a super-plasticity characteristic, and then performs blow-forming that forms a material to a final product shape at a super-plasticity temperature of an aluminum alloy sheet (P, FIG. 2) such that a product can be produced by one mold set to have a deep forming depth and a complicated shape.

A multi-forming device according to an exemplary embodiment of the present invention includes a lower mold die 1, a lower mold 3, an upper mold 5, a blank holder 7, an inner gas pipe 19, and a switch valve 21.

The lower mold die 1 is disposed on a bolster of a process, and a space portion (SP) is formed at an inner side of a center thereof.

The lower mold 3 is disposed at a center upper surface of the lower mold die 1, a gas passage L1 is formed therein in an up-and-down direction, and a lower mold surface 3*a* is formed at an upper surface thereof. A plurality of heating cartridges 13 are disposed in the lower mold 3 along the lower mold surface 3*a*, and the cartridges 13 are configured to heat the lower mold 3 to a predetermined temperature through power control of a power supplier device 15.

The gas passage L1 is connected with a gas supplier device 11 that supplies high pressure shaping gas through a gas supply pipe L2. In a condition that the gas supply pipe L2 is connected with the gas supplier device 11, the pipe L2 is connected with the gas passage L1 through the space portion (SP) of the lower mold die 1.

The lower mold surface 3*a* has an incomplete product shape surface so as to deform a sheet to only a maximum deformation depth.

The upper mold 5 is engaged with a slider 9 of an upper portion to be able to move up and down corresponding to the lower mold 3 at an upper side of the lower mold 3. An upper mold surface 5*a* is formed at a lower surface of the upper mold 5 corresponding to the lower mold 3, and an upper mold face 5*b* is formed at a circumference of the upper mold surface 5*a*.

A plurality of heating cartridges 13 are disposed in the upper mold 5 along the upper mold surface 5*a*, and the cartridge 13 heats the upper mold 5 to a predetermined temperature through power control of the power supplier device 15.

The upper mold surface 5*a* has a final product shape so as to deform a sheet to a final shape.

A controller C of the power supplier device 15 controls the temperature of the heating cartridge 13 in the upper mold 5 and the lower mold 3. The controller C controls the gas supplier device 11 so as to control a supply amount and supply pressure of a deformation gas that is supplied into the mold through the gas supply pipe L2 and the gas passage L1.

The lower mold 3 is inserted into the blank holder 7, and the blank holder 7 is disposed to be able to move in an up-and-down direction through a cushion spring 17 on the lower mold die 1.

The blank holder 7 forms a holder face 7*a* that grasps a sheet together with the upper mold face 5*b* at an early stage of a forming process.

The inner gas pipe 19 is disposed to penetrate a central portion of an inside of the gas passage L1 of the lower mold 3. An expanding tube portion 19*a* that is expanded to a trumpet shape is formed at an upper end of the lower mold surface 3*a* such that high temperature and high pressure deforming gas is induced to be spread.

In this condition, an expanded hole portion L1*a* that is expanded to correspond to the expanded tube portion 19*a* of the inner gas pipe 19 is formed at the gas passage L1.

A spiral type of swirl rib SL is formed on an exterior circumference of the expanded tube portion 19*a* of the inner gas pipe 19 to generate swirl within the shaping gas that is supplied through the gas passage L1.

The switch valve 21 is configured to switch a supply passage of the shaping gas that is supplied through the inner gas pipe 19 and the gas passage L1.

The switch valve 21 can be disposed at a connection portion of the gas supply pipe L2 and the gas passage L1, and a valve housing 23 is fixed on a lower surface of the lower mold 3 at an inner portion of the space portion SP of the lower mold die 1.

The valve housing 23 includes a first port P1 that receives hydraulic pressure from the gas supply pipe L2, a second port P2 that supplies hydraulic pressure received from the first port P1 to the inner gas pipe 19, and a third port P3 that supplies hydraulic pressure received from the first port P1 to the gas passage L1.

A valve spool 25 is disposed in the valve housing 23, and the valve spool 25 includes a first land LD1 that is supported by a return spring 27 of an inner portion of the valve housing 23, a second land LD2 that forms a passage connecting the first port P1 with the second port P2 together with the first land LD1, and the third land LD3 that forms a passage connecting the first port P1 with the second port P2 and a third port P3 together with the second land LD2.

A solenoid 29 is disposed to operate the valve spool 25, and as shown in FIG. 1, an operating rod 29*a* of the solenoid 29 is connected with one end of the valve spool 25 to draw or push the valve spool 25 depending on a control signal.

FIG. 2 to FIG. 6 show a step-by-step operational state of a multi-forming device according to an exemplary embodiment of the present invention.

Hereinafter, referring to FIG. 2 to FIG. 6, operations of a multi-forming device according to an exemplary embodiment of the present invention will be described in stages.

A multi-forming device according to an exemplary embodiment of the present invention is sequentially operated through five steps.

Figure 2:
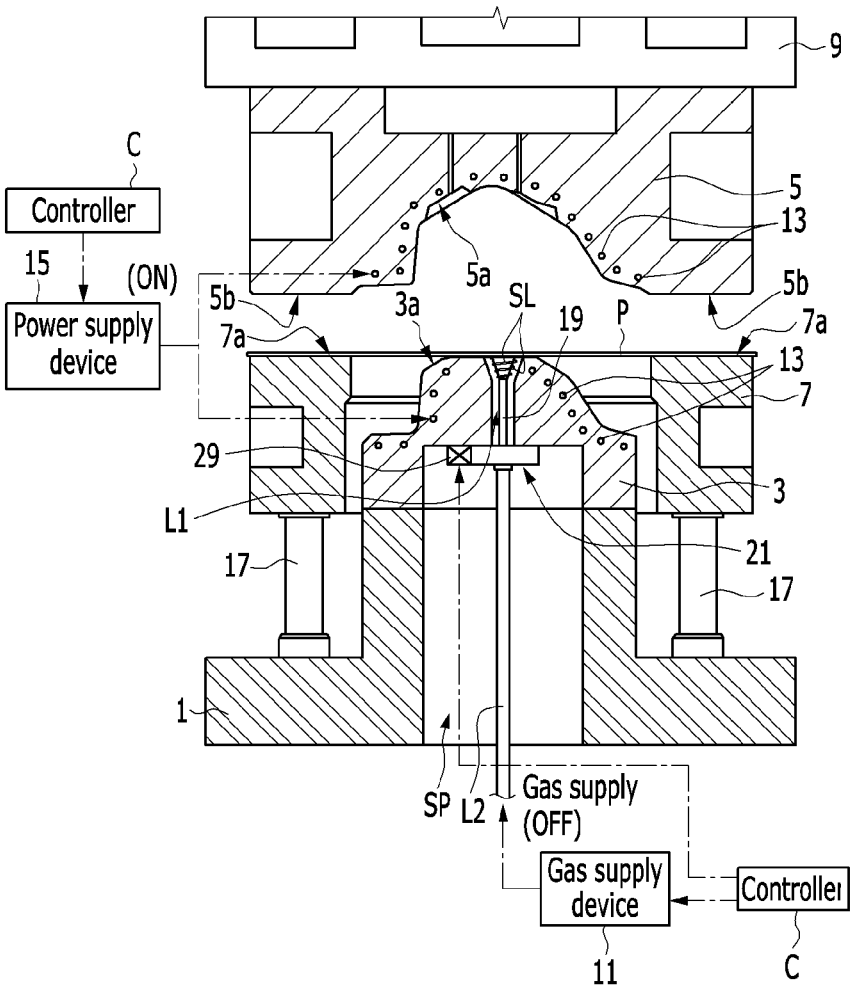
FIG. 2 to FIG. 7 show a step-by-step operational state of a multi-forming device according to an exemplary embodiment of the present invention.

Firstly, in a first step, referring to FIG. 2, the aluminum alloy plate (P) having super-plasticity is disposed on the lower mold 3 and the blank holder 7 that is raised to the lower mold 3.

Figure 3:
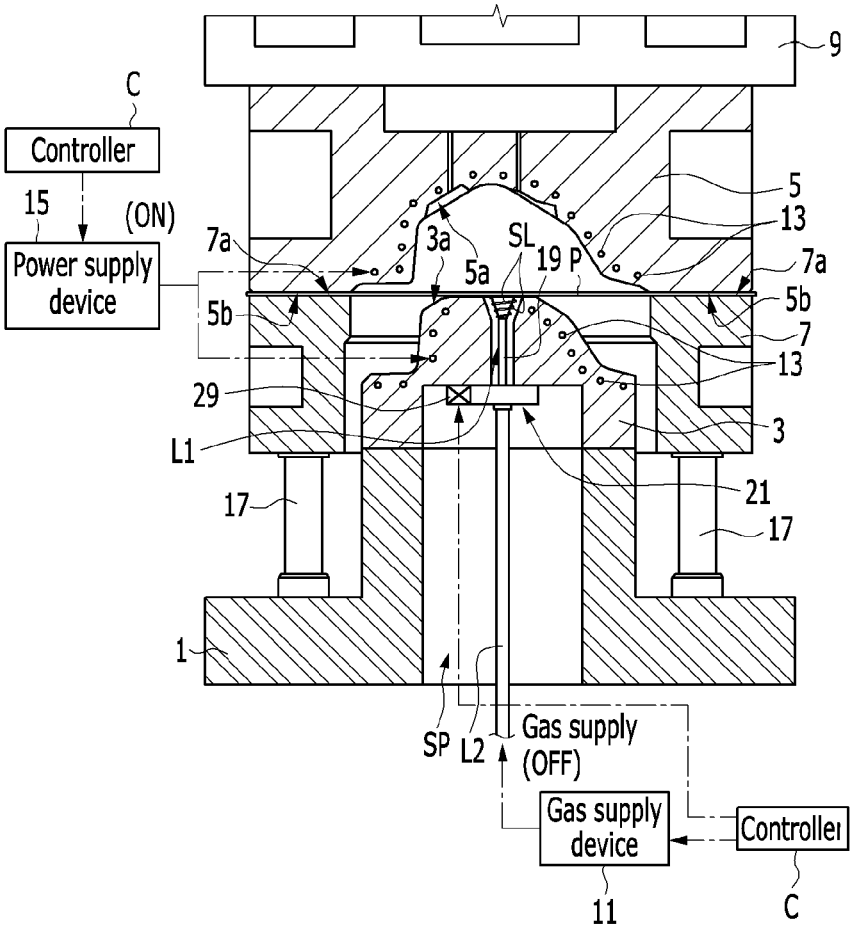

Subsequently, in a second step, referring to FIG. 3, the upper mold 5 is moved down by the slider 9 to grasp an edge of the aluminum alloy plate (P) together with the blank holder 7, and heating cartridges 13 of the upper mold 5 and the lower mold 3 heat the aluminum alloy plate (P) to a warm forming temperature.

Here, the edge of the aluminum alloy plate (P) is held by the upper mold face 5*b* and the holder face 7*a* between the upper mold 5 and the blank holder 7, and the warm forming temperature can be set to a smaller value than an annealing temperature that decreases potential density within the aluminum alloy plate (P) having super-plasticity.

Figure 4:
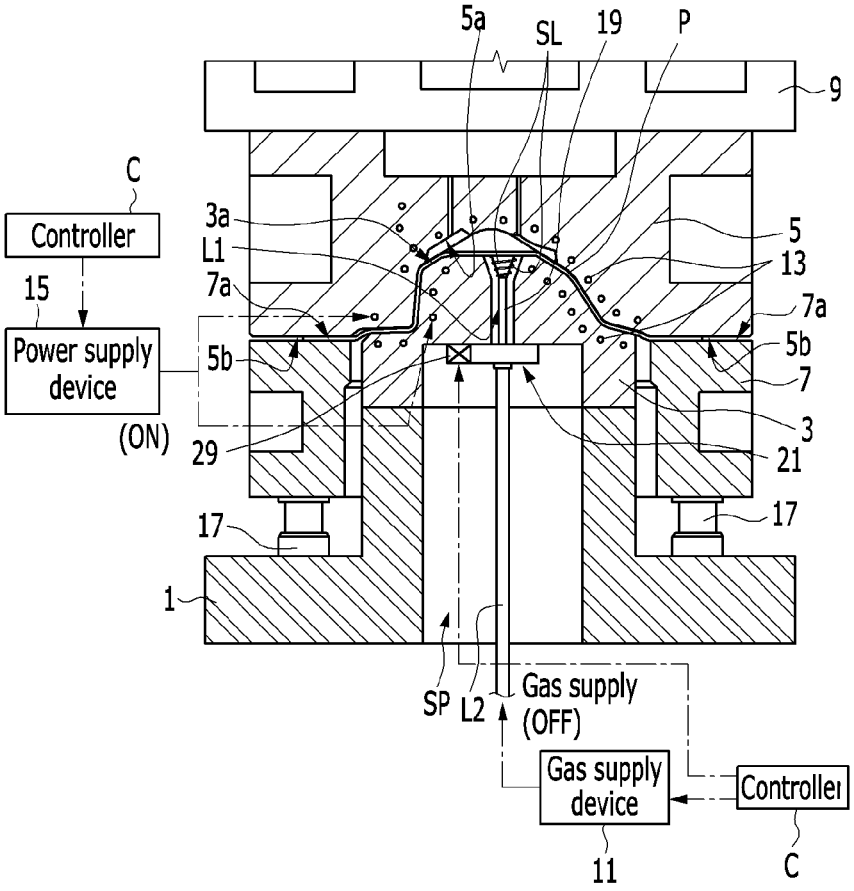

Subsequently, in a third step, referring to FIG. 4, if the aluminum alloy plate (P) is heated to a warm forming temperature, the upper mold 5 is combined with the lower mold 3 by the slider 9, and the aluminum alloy plate (P) is plastic-deformed by pressure to be deformed to a maximum deformation depth.

In this warm forming process, the aluminum alloy plate (P) is plastic-deformed to a maximum deformation depth to have a first forming shape.

Figure 5:
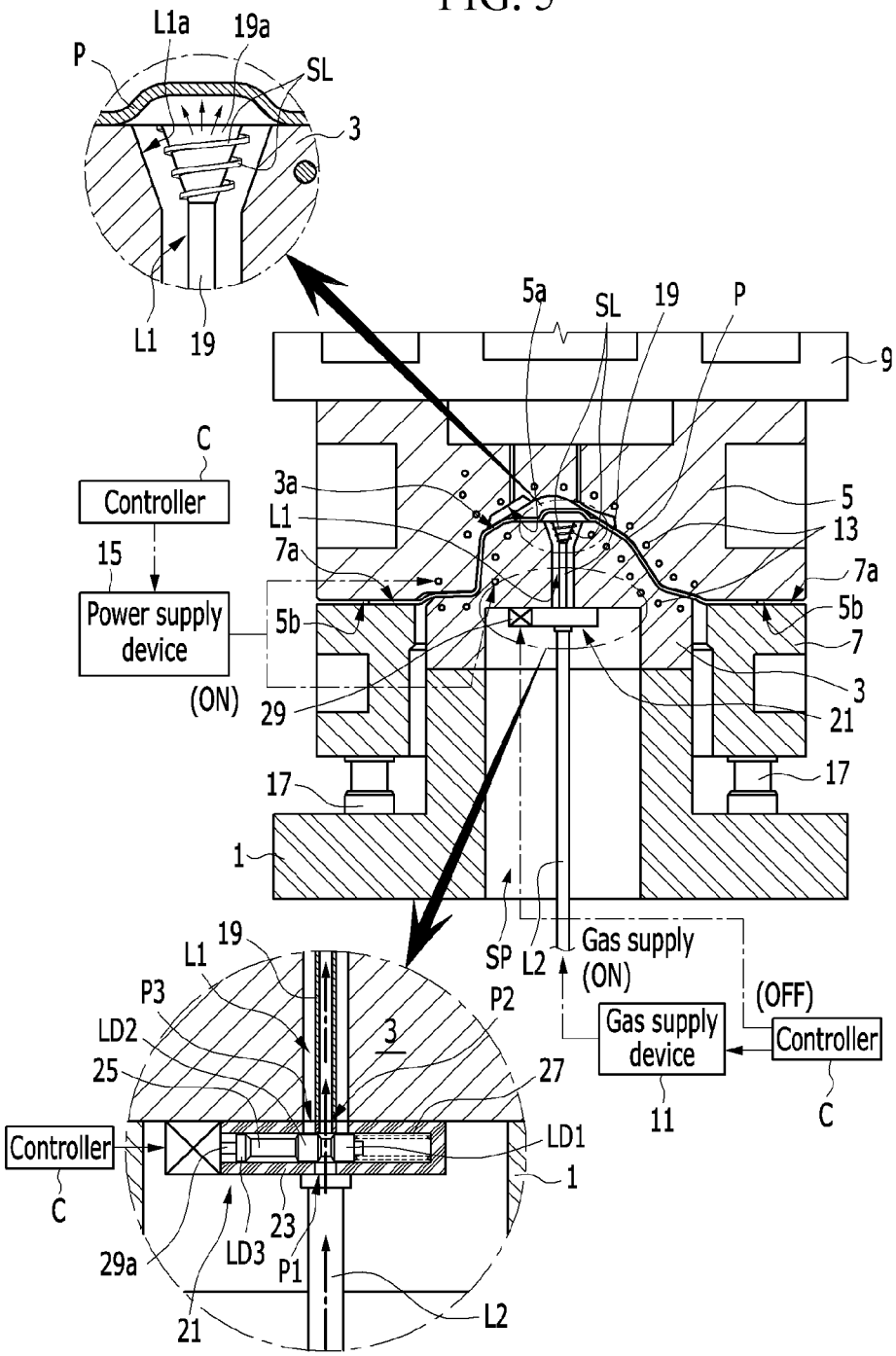
Figure 6:
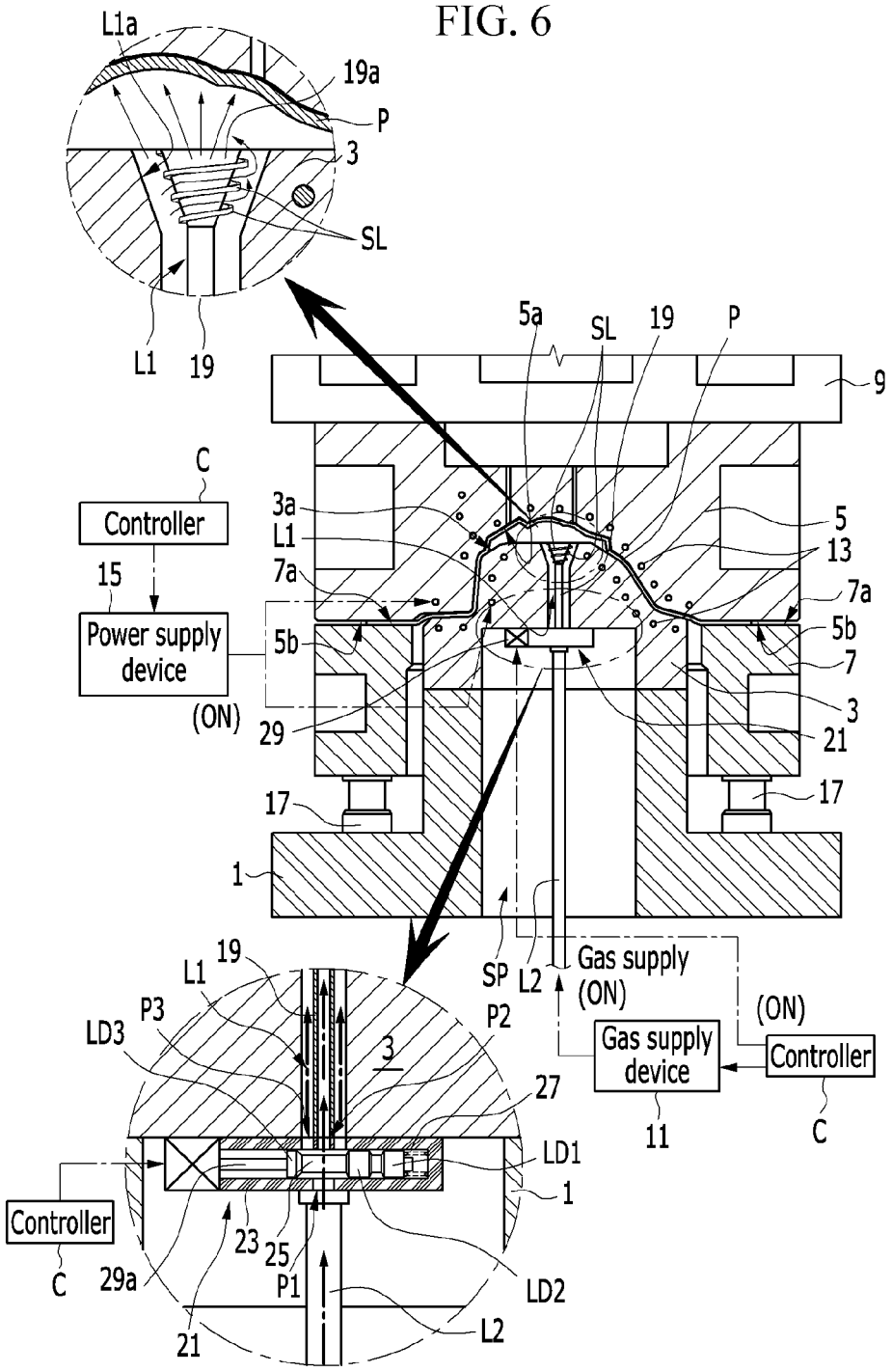

In this condition in which the upper mold 5 and the lower mold 3 are combined with each other, a fourth step is performed, and referring to FIG. 5 and FIG. 6, an aluminum alloy plate (P) that is warm-formed to a maximum deformation depth is further heated by the heating cartridge 13 to a super-plasticity temperature.

Next, the high pressure shaping gas is supplied through the gas passage L1 formed in the lower mold 3 and the inner gas pipe 19, and the aluminum alloy plate (P) is expanded by the gas pressure along the upper mold surface 5*a* of the upper mold 5 to be deformed to a final shape of a product.

As described in FIG. 5, in the blow forming, the solenoid 29 of the switch valve 21 is turned off, and the switch valve 21 supplies the inner gas pipe 19 with the high temperature and high pressure shaping gas that is supplied from the gas supply pipe L2.

That is, as shown in FIG. 5, the switch valve 21 forms a passage connecting the first port P1 of the valve housing 23 with the second port P2, in a condition in which the solenoid 29 is turned off and the valve spool 25 is moved to a left side by elastic force of the return spring 27.

Thereby, the shaping gas that is supplied from the gas supply pipe L2 is supplied to the inner gas pipe 19 through the first port P1 and the second port P2, and the shaping gas is supplied to the aluminum alloy plate P, which contacts the lower mold surface 3*a* of the lower mold 3, through the inner gas pipe 19 at an initial deforming pressure.

Then, the aluminum alloy plate (P) is deformed by the shaping gas that is partially supplied through the inner gas pipe 19 at an early stage of the gas deformation.

In this condition, referring to FIG. 6, the solenoid 29 of the switch valve 21 is controlled to be operated, and the switch valve 21 supplies the gas passage L1 as well as the inner gas pipe 19 with the high temperature and high pressure shaping gas that is supplied from the gas supply pipe L2.

That is, as shown in FIG. 6, the solenoid 29 is turned on and the valve spool 25 compresses the return spring 27 to move to a right side, and the switch valve 21 forms a passage that connects the first port P1 of the valve housing 23 with the second and the third port P2 and P3.

Thereby, the shaping gas that is supplied through the gas supply pipe L2 is supplied to the inner gas pipe 19 and the gas passage L1 through the first port P1, and the second and third ports P2 and P3, and the shaping gas is supplied to the aluminum ally plate P, which is deformed at an initial stage and contacts the lower mold surface 3*a* of the lower mold 3, through the inner gas pipe 19 and the gas passage L1 at a main deforming pressure.

In this process, the shaping gas that is supplied through the gas passage L1 is swirled by the expanded tube portion 19*a* of the inner gas pipe 19 and the swirl rib SL that is formed along the exterior circumference of the expanded tube portion 19*a* to be spread between the lower mold surface 3*a* of the lower mold 3 and the aluminum alloy plate (P) such that the shaping gas is efficiently supplied.

The blow forming forms an initial forming pressure to partially deform the aluminum alloy plate (P) through the inner gas pipe 19 that is operated by the switch valve 21 that is disposed on the gas passage L1 of the lower mold 3, and the shaping gas that is supplied through the inner gas pipe 19 and the gas passage L1 is swirled such that the shaping gas having a high temperature and high pressure does not leak and is uniformly spread to a deformation portion to improve blow formability.

Figure 7:
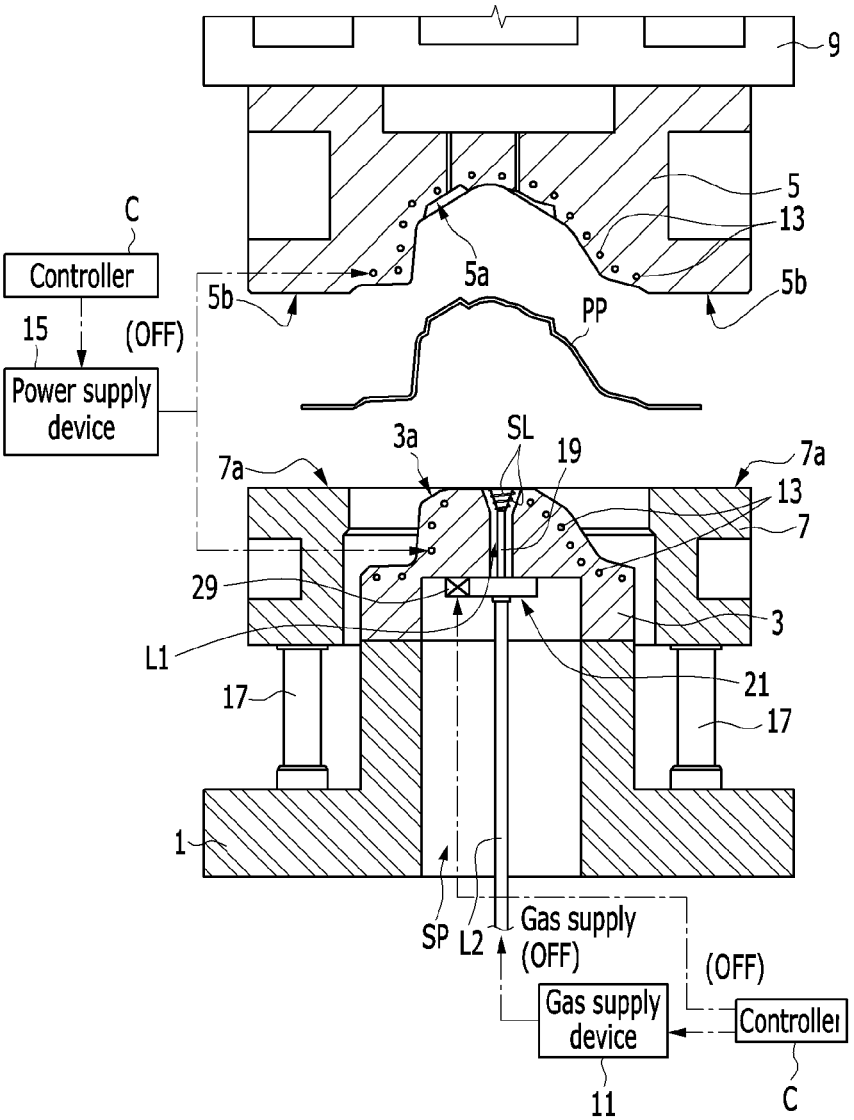

Subsequently, referring to FIG. 7, in a fifth step, the upper mold 5 is raised by the operation of the slider 9 to be separated from the lower mold 3, as aluminum alloy formed product (PP) having a final shape is completed.

In this way, a multi-forming device according to an exemplary embodiment of the present invention performs warm forming that deforms a material to a maximum deformation depth through pressurized plastic deformation below an annealing temperature that lowers dislocation density within an aluminum alloy sheet (P) having a super-plasticity characteristic, and then heats the aluminum alloy sheet to a super-plasticity temperature to perform blow-forming that deforms a material to a final product shape such that a product can be produced to have a deep forming depth and a complicated shape, and therefore it is not necessary to prepare a separate mold.

Further, in a multi-forming device according to an exemplary embodiment of the present invention, the number of components is reduced and the cost can be saved through a minimized number of processes when a product of which a forming depth is deep and a shape is complicated is formed, and therefore there is a merit in terms of cost, and complicated parts in the product are formed through blow-forming in which a gas pressure enlarges the material through non-contact with a mold and thus there is a merit of minimizing the defect rate compared with a conventional die casting method.

In addition, while a product is deformed to a final shape through blow forming at a super-plasticity temperature of aluminum alloy, a swirl is formed within the shaping gas that has passed a gap of a deformed aluminum alloy plate P through a gas passage, and thus a high temperature shaping gas does not leak and uniformly flows therein to improve blow formability, in a condition in which the inner gas pipe 19 is disposed in the gas passage L1 of the lower mold 3 to be opened/closed by the switch valve 21 and an initial pressure is generated to deform the aluminum alloy plate P.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

1: lower mold die
3: lower mold
5: upper mold
7: blank holder
9: slider
11: gas supplier device
13: heating cartridge
15: power supplier device
17: cushion spring
19: inner gas pipe
21: switch valve
23: valve housing
25: valve spool
27: return spring
29: solenoid
P: aluminum alloy plate
PP: aluminum alloy formed product
SP: space portion
L1: gas passage
L2: gas supply pipe
C: controller
3*a*: lower mold surface
5*a*: upper mold surface
5*b*: upper mold face
7*a*: holder face

What is claimed is:

1. A multi-forming device, comprising:

a lower mold die;

a lower mold that is disposed at a center upper surface of the lower mold die, in which a gas passage is formed in an up-and-down direction therein to receive a shaping gas from an outside gas supplier device, in which a lower mold surface is formed at an upper surface thereof, and in which a plurality of heating cartridges are disposed therein along the lower surface thereof;

an upper mold that is disposed on an upper side slider to be moved in an up-and-down direction corresponding to the lower mold, in which an upper mold surface is formed at a lower surface corresponding to the lower mold, in which an upper mold face is formed at a circumference of the upper mold surface, and in which a plurality of heating cartridges are disposed along the upper mold surface;

a blank holder through which the lower mold is inserted and that is disposed to move in an up-and-down direction through a cushion spring on the lower mold die, and in which a holder face is formed to grasp a material together with the upper mold face at an early stage of a forming process, an inner gas pipe that is disposed in the gas passage of the lower mold; and a switch valve that switches supply passages of the shaping gas that is supplied to the inner gas pipe and the gas passage.

2. The multi-forming device of claim 1, wherein the material includes a super-plasticity material.

3. The multi-forming device of claim 2, wherein the super-plasticity material is an aluminum alloy plate.

4. The multi-forming device of claim 3, wherein the inner gas pipe is disposed to penetrate a central portion of an inside of the gas passage, and an expanded tube portion that is expanded to a trumpet shape is formed at an upper end portion that is close to a lower mold surface.

5. The multi-forming device of claim 2, wherein the inner gas pipe is disposed to penetrate a central portion of an inside of the gas passage, and an expanded tube portion that is expanded to a trumpet shape is formed at an upper end portion that is close to a lower mold surface.

6. The multi-forming device of claim 1, wherein the inner gas pipe is disposed to penetrate a central portion of an inside of the gas passage, and an expanded tube portion that is expanded to a trumpet shape is formed at an upper end portion that is close to a lower mold surface.

7. The multi-forming device of claim 6, wherein a spiral swirl rib is formed on an exterior circumference of the expanded tube portion to swirl shaping gas that is supplied from the gas passage.

8. The multi-forming device of claim 6, wherein an expanded hole portion of which an interior diameter becomes larger is formed on the gas passage corresponding to the expanded tube portion.

9. The multi-forming device of claim 1, wherein a gas supply pipe is connected with the gas passage through a space portion that is formed at a center portion of the lower mold die.

10. The multi-forming device of claim 1, wherein the switch valve comprises:

a valve housing that has a first port receiving hydraulic pressure from the gas supply pipe, a second port that supplies hydraulic pressure of the first port to the inner gas pipe, and a third port that supplies hydraulic pressure of the first port to the gas passage;

a valve spool that has a first land supported by a return spring of the valve housing, a second land that forms a passage connecting the first port with the second port together with the first land, and a third land simultaneously connecting the first port, the second port, and the third port with each other together with the second land; and a solenoid that is connected with one end of the valve spool to operate the valve spool depending on a control signal.

11. The multi-forming device of claim 1, wherein the lower mold surface has an incomplete product shape so as to deform the material to a maximum deformation depth.

12. The multi-forming device of claim 1, wherein the upper mold surface has a final product shape surface to deform the material to a final product shape.

13. A multi-forming device, comprising:

a lower mold die that is disposed on a bolster of a process and in which a space portion is formed at a center portion thereof;

a lower mold that is disposed on an upper surface of the center portion of the lower mold die, in which a gas passage is formed in an up-and-down direction to be connected with an outside gas supplier device through a gas supply pipe in a space portion of the lower mold die, in which a lower mold surface having an incomplete product shape is formed on an upper surface thereof to deform a super-plasticity material to a maximum deformation depth, and in which a plurality of heating cartridges are disposed along the lower mold surface so as to heat the super-plasticity material to a warm-forming temperature or a super-plasticity temperature;

an upper mold that is disposed on an upper side slider to be moved up and down corresponding to the lower mold, in which an upper mold surface having a final product shape is formed on a lower surface corresponding to the lower mold so as to deform a material to a final product shape, in which an upper mold face is formed on a circumference of the upper mold surface, and in which a plurality of heating cartridges are disposed along the upper mold surface so as to heat a super-plasticity material to a warm-forming temperature or a super-plasticity temperature;

a blank holder through which the lower mold is inserted and that is disposed to move in an up-and-down direction through a cushion spring on the lower mold die, and in which a holder face is formed to grasp the super-plasticity material together with the upper mold face at an early stage of a forming process;

an inner gas pipe that penetrates an inner center portion of the gas passage of the lower mold;

an expanded tube portion that is expanded to a trumpet shape and is formed at an upper end portion thereof close to the lower mold surface;

a spiral swirl rib that is formed on an exterior circumference of the expanded tube portion so as to swirl a shaping gas supplied from the gas passage; and a switch valve that switches supply passages of a shaping gas that is supplied to the inner gas pipe and the gas passage.

14. The multi-forming device of claim 13, wherein the super-plasticity material is an aluminum alloy plate.

15. The multi-forming device of claim 13, wherein an expanded hole portion of which an interior diameter becomes larger is formed on the gas passage corresponding to the expanded tube portion.

16. The multi-forming device of claim 13, wherein the switch valve comprises:

a valve housing that has a first port receiving hydraulic pressure from the gas supply pipe, a second port that supplies hydraulic pressure of the first port to the inner gas pipe, and a third port that supplies hydraulic pressure of the first port to the gas passage;

a valve spool that has a first land supported by a return spring of the valve housing, a second land that forms a passage connecting the first port with the second port together with the first land, and a third land simultaneously connecting the first port, the second port, and the third port with each other together with the second land; and a solenoid that is connected with one end of the valve spool to operate the valve spool depending on a control signal.

17. The multi-forming device of claim 13, wherein the warm forming temperature is set to a value of less than an annealing temperature that lowers potential density within the material having super-plasticity.

* * * * *